United States Patent [19]

Ibata et al.

[11] Patent Number: 4,623,404

[45] Date of Patent: Nov. 18, 1986

[54] METHOD FOR MAKING PERMANENT MAGNETS OF Mn-Al-C ALLOYS

[75] Inventors: Akihiko Ibata, Izumisano; Yoichi Sakamoto, Suita, both of Japan

[73] Assignee: Matsushita Electric Industrial Company, Limited, Japan

[21] Appl. No.: 486,244

[22] Filed: Apr. 18, 1983

[30] Foreign Application Priority Data

Apr. 19, 1982 [JP] Japan ..... 57-65909

[51] Int. Cl.[4] ..... H01F 1/02

[52] U.S. Cl. ..... 148/101; 148/120; 148/314

[58] Field of Search ..... 148/31.57, 100, 101, 148/102, 120, 121; 29/607; 72/700, 707

[56] References Cited

U.S. PATENT DOCUMENTS

| | | | |
|---|---|---|---|
| 3,266,954 | 8/1966 | Hokkeling et al. | 148/31.57 |
| 3,944,445 | 3/1976 | Ohtani et al. | 148/120 |
| 4,023,991 | 5/1977 | Kubo et al. | 148/31.57 |
| 4,042,429 | 8/1977 | Kojima et al. | 148/120 |
| 4,051,706 | 10/1977 | Sakamoto et al. | 148/120 |
| 4,055,732 | 10/1977 | Yoshimura et al. | 148/120 |
| 4,133,703 | 1/1979 | Kojima et al. | 148/31.57 |
| 4,404,046 | 9/1983 | Sakamoto et al. | 148/101 |

FOREIGN PATENT DOCUMENTS

| | | |
|---|---|---|
| 0016960 | 10/1980 | European Pat. Off. . |
| 0092422 | 10/1983 | European Pat. Off. . |

OTHER PUBLICATIONS

Chemical Abstracts, vol. 84, No. 20, 17th May 1976, p. 602, No. 143988y, Columbus, Ohio, USA; & JP-A-76 12319 (Matsushita Electric Industrial Co., Ltd.) 30-0-1-1976.

IEEE Transactions on Magnetics, vol. MAG-17, No. 6, Nov. 1981, pp. 2651-2653, New York, USA; Z. A. Abdelnour et al.: "Permanent Properties of Mn-Al-C between −50 C and +150 C", p. 2651, right-hand col., last paragraph-p. 2652, left-hand col., paragraph 1.

JEE Journal of Electron Engineering, No. 127, Jul. 1977, pp. 50-54, T. Kubo et al.: "Anisotropic Mn-Al-C Alloy Permanent Magnets can be Machined and Mass Produced" p. 52, left-hand col., last paragraph-p. 53, left-hand column, paragraph 1; FIG. 2.

*Primary Examiner*—John P. Sheehan

*Attorney, Agent, or Firm*—Lowe, Price, Leblanc, Becker & Shur

[57] ABSTRACT

Anisotropic Mn-Al-C alloy magnets exhibiting excellent magnetic characteristics in multipolar magnetization are described. The magnets are obtained by subjecting a polycrystalline Mn-Al-C alloy magnet, which is rendered anisotropic, to compressive working or extrusion at a temperature of from 530° to 830° C. while keeping restrained at least part of the hollow billet along its length so that the at least part is prevented from suffering compressive deformation until fed into a compressive working region. Permanent magnets obtained by the method are also described.

14 Claims, 8 Drawing Figures

METHOD FOR MAKING PERMANENT MAGNETS OF Mn-Al-C ALLOYS

BACKGROUND OF THE INVENTION

1. Field of the Invention

This invention relates to permanent magnets and more particularly, to a method for making permanent magnets of polycrystalline manganese-aluminium-carbon alloys suitable for multipolar magnetization. Also, it relates to permanent magnets obtained by the method.

2. Description of the Prior Art

Mn—Al—C alloy magnets are mainly constituted of the structure of ferromagnetic face-centered tetragonal phase ($\tau$ phase L1o type superstructure) and contain carbon as their essential component element. The magnets include those magnets of ternary alloys free of any additive elements except for inevitable impurities and quaternary or multicomponent alloys which contain small amounts of additive elements. By the term "Mn—Al—C alloy magnet" used herein are meant magnets of all the alloys including quaternary or multicomponent alloys as well as ternary alloys.

Known methods of making Mn—Al—C alloy magnets include, aside from those methods using casting and heat treatments, a method which comprises a warm plastic working process such as warm extrusion. The latter method is known as a method of making an anisotropic magnet which has excellent properties such as high magnetic characteristics, mechanical strength and machinability.

On the other hand, Mn—Al—C alloy magnets for multipolar magnetization can be made by several techniques including a technique using isotropic magnets or compressive working, and a technique in which a uniaxially anisotropic polycrystalline Mn—Al—C alloy magnet obtained by a known method such as warm extrusion is subjected to warm free compressive working in a direction of easy magnetization, i.e. a compound working method.

However, the compound working method includes a free compressive process. When a work is assumed to be in the form of a solid cylinder, a too high ratio $L_o/D_o$ where $D_o$ represents a diameter of the cylinder and $L_o$ represents a length of the cylinder will produce the problem of failure of the work due to buckling.

This will impose the limitation that a ratio L/D in which D and L, respectively, represent a diameter and a length of a work after the free compression cannot be made large. Accordingly, it is necessary to use several magnets in order to obtain a long magnet with a high L/D ratio. For instance, Mn—Al—C alloy magnets are so excellent in mechanical strength and machinability that they can be applied in the form of a rod of monolithic magnet for the purpose of outer lateral magnetization. However, long magnets cannot be obtained using any hitherto known methods. Thus it is the usual practice that a plurality of Mn—Al—C alloy magnet pieces are machined into hollow cylinders and are joined together for practical applications. Long magnets have another advantage in that magnets of any shorter sizes can be obtained by cutting the long magnet into pieces of a desired length.

SUMMARY OF THE INVENTION

It is an object of the present invention to provide a method for making Mn—Al—C alloy magnets of different anisotropic structures suitable for multipolar magnetization.

It is another object of the invention to provide a method for making Mn—Al—C alloy magnets in which a hollow billet of a polycrystalline Mn—Al—C alloy magnet is extruded or compressed so that the billet is gradually plastically deformed and imparted with a desired degree of compressive strain along an axial direction of the billet while protecting a part of the billet from compressive deformation whereby long magnets for mulitpolar magnetization can readily be obtained without failures such as buckling.

It is a further object of the invention to provide a method for making Mn—Al—C alloy magnets by which long magnets of desired anisotropic structures can be obtained relatively simply.

It is a still further object of the invention to provide Mn—Al—C alloy magnets obtained by the method.

The above objects can be achieved, according to the invention, by a method for making an Mn—Al—C alloy magnet which comprises providing a hollow billet made of a polycrystalline Mn—Al—C alloy magnet which is rendered anisotropic, and subjecting the hollow billet to compressive working at a temperature of from 530° to 830° C. while keeping restrained at least part of the hollow billet along its length so that the part is prevented from suffering compressive deformation until fed into a compressive working region. This can be realized using an extrusion die which has a core and a surrounding member such as a ring die coaxially spaced from the core thereby establishing a cavity therebetween. The cavity has a container portion receiving at least a part of the hollow billet prior to the compressive working, an intermediate portion with an increasing sectional area, and a bearing portion having a sectional area larger than the container portion. The intermediate and bearing portions constitute the compressive working region. When compressed, the billet is plastically deformed but a portion thereof in the container portion is prevented from compressive deformation.

According to a more specific and preferred embodiment of the invention, there is provided a method for making an Mn—Al—C alloy magnet which comprises providing a hollow cylindrical billet made of a polycrystalline Mn—Al—C alloy magnet which is rendered anisotropic, and compressing the hollow cylindrical billet at a temperature of from 530° to 830° C. while keeping restrained the hollow cylindrical billet on its inner and outer surfaces whereby the billet is gradually plastically deformed in radial directions on its movement into a working area under restraining conditions.

DETAILED DESCRIPTION AND EMBODIMENTS OF THE INVENTION

Figure 1B:
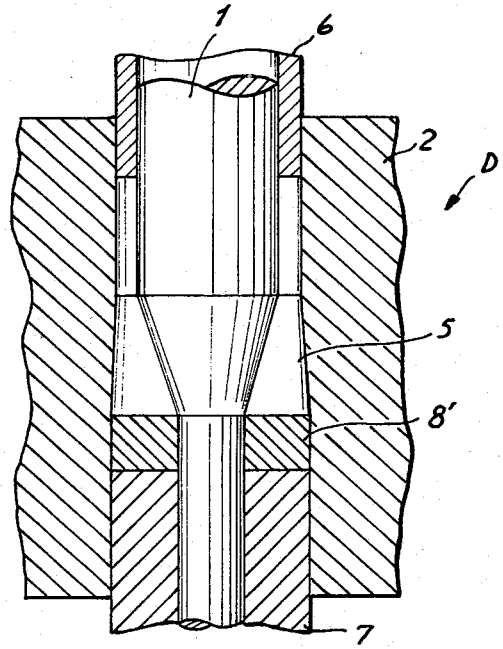
FIGS. 1(*a*) and 1(*b*) are schematic sectional views showing part of a die illustrating one embodiment of a compressive working process according to the invention.

As described before, Mn—Al—C alloy magnets of high performance suitable for multipolar magnetization can be smoothly made without problems such as buckling by subjecting at a temperature of 530° to 830° C. a hollow billet of a polycrystalline Mn—Al—C alloy magnet, which is rendered anisotropic, to the extrusion using a die. The die has a core and a surrounding member such as a ring die in a coaxially spaced relation with the core. Accordingly, a cavity is established between the core and surrounding member and is divided into at least three portions including container, intermediate and bearing portions.

The die is so designed that a cavitied or sectional area of the container portion is smaller than a cavitied or sectional area of the bearing portion. The intermediate portion has a sectional area increased gradually toward the bearing portion. The extrusion or compressive working is effected such that the hollow billet is moved from the container to bearing portions and is gradually plastically deformed in the intermediate and bearing portions and is kept restrained in the container portion.

Polycrystalline Mn—Al—C alloy magnets which are rendered anisotropic can be obtained by subjecting to known plastic working such as extrusion at a temperature ranging from 530° to 830° C. known Mn—Al—C alloys for magnets, e.g. alloys composed of 68 to 73 wt % of Mn, (1/10 Mn - 6.6) to (1/3 Mn - 22.2) wt % of C. and the balance of Al. Typical of the polycrystalline magnets are uniaxially anisotropic magnets which are obtained by extrusion and have a direction of easy magnetization in the extrusion direction, and plane-anisotropic permanent magnets obtained by the afore-mentioned compound working method.

According to the invention, these polycrystalline Mn—Al—C alloy magnets imparted with anisotropy are formed into hollow billets. The hollow billet is compressed or extruded using a die of the specific type described before.

By the term "container portion" used herein is meant a portion where a hollow billet to be compressed or extruded is accomodated prior to extrusion and serves to protect the billet from compressive deformation upon application of compressive or extrusion force thereto. The term "bearing portion" means a portion where a compressed billet is accomodated and which has a larger sectional area than the container portion.

In order to impart a compressive strain to a hollow billet using the die in which a cavitied or sectional area of the container portion is smaller than a cavitied or sectional area of the bearing portion, it is preferable to apply a compressive load to the billet from opposite vertical directions while slowly moving the billet towards the portion of a larger sectional area.

For instance, when a hollow billet is compressively pressed at the ends from opposite directions while moving the billet from the container portion toward the bearing portion, a compressive strain is produced in the direction of compression. In this instance, a region of plastic deformation within the billet occurring during the course of the extrusion continuously changes as a function of time. As a matter of course, it is possible not to continuously change a region of plastic deformation in relation to time.

When the hollow billet is made of a polycrystalline Mn—Al—C alloy magnet having a direction of easy magnetization along the axial direction of the billet ( i.e. uniaxially anisotropic magnet), the compressive strain should preferably exceed 0.05 when expressed by an absolute value of logarithmic strain. This is because, as will be described in more detail in the examples, the billet prior to compression is rendered anisotropic in the direction of compression and thus a compressive strain of at least 0.05 is necessary so as to change the structure of the billet into a magnet having high magnetic characteristics in multipolar magnetization.

There is known a prior art method where a uniaxially anisotropic magnet of a square pillar form is subjected to hot compressive working along the direction of axis of the magnet. In this instance, it is intended to change the direction of easy magnetization from the uniaxial anisotropy to an axis perpendicular thereto. Accordingly, the resulting square pillar magnet is kept uniaxially anisotropic even after the working. The change in the direction of easy magnetization to a certain direction according to the above prior art technique needs a working of about 60-70% or more. This corresponds to an absolute value of logarithmic strain as high as about 0.9 to 1.2 or more.

When the billet is made of a polycrystalline Mn—Al—C alloy magnet which has the direction of easy magnetization parallel to a plane perpendicular with respect to the axial direction of the hollow billet (i.e. plane-anisotropic permanent magnet), is magnetically isotropic within the plane, and is anisotropic in a direction of a perpendicular of the plane and within a plane including a straight line parallel to the first-mentioned plane, the billet prior to extrusion exhibits high magnetic characteristics in all directions within a plane including radial and tangential directions. When compressed, the magnet can exhibit higher magnetic characteristics in multipolar magnetization.

One embodiment of the afore-described plastic working according to the invention is illustrated using a billet in the form of the hollow cylinder, with reference to the accompanying drawings in which like parts are designated by like reference numerals throughout the specification.

Figure 1A:
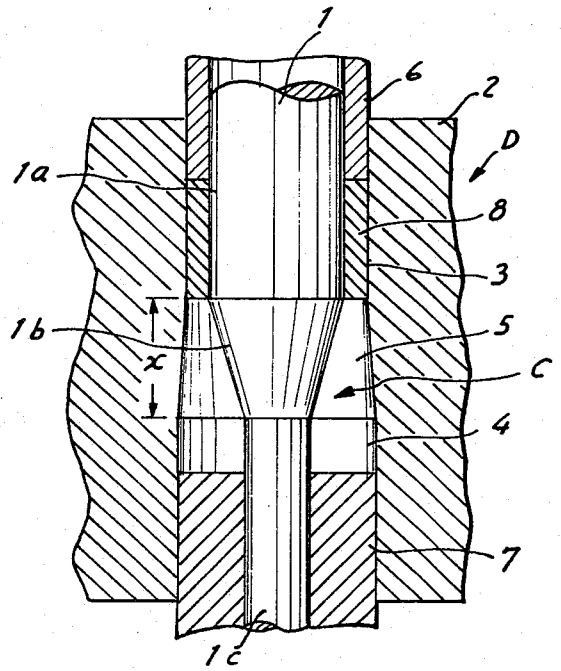
Figure 2B:
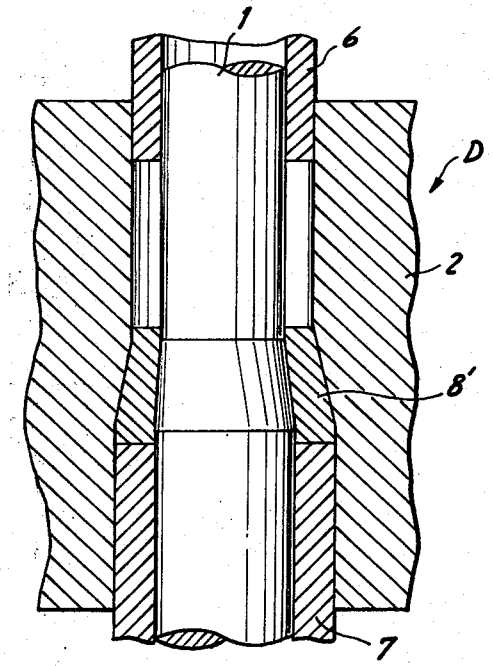
FIGS. 2(*a*) through 2(*d*) are schematic sectional views showing part of a die illustrating another embodiment of an extrusion or compressive working process according to the invention.
Figure 2A:
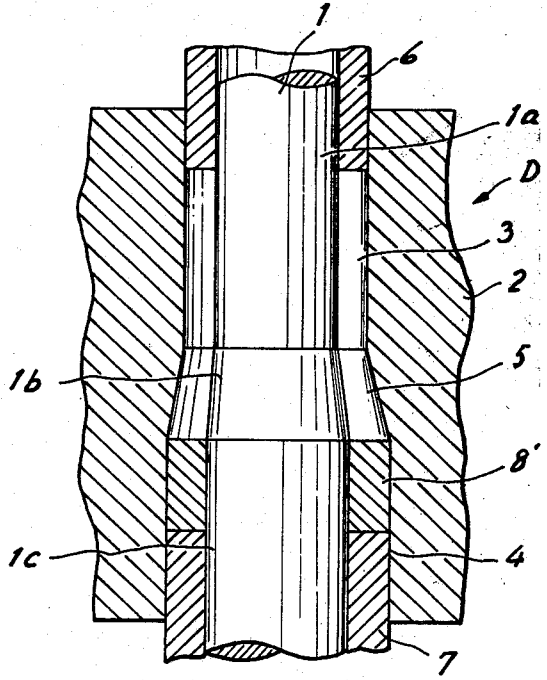
Figure 2D:
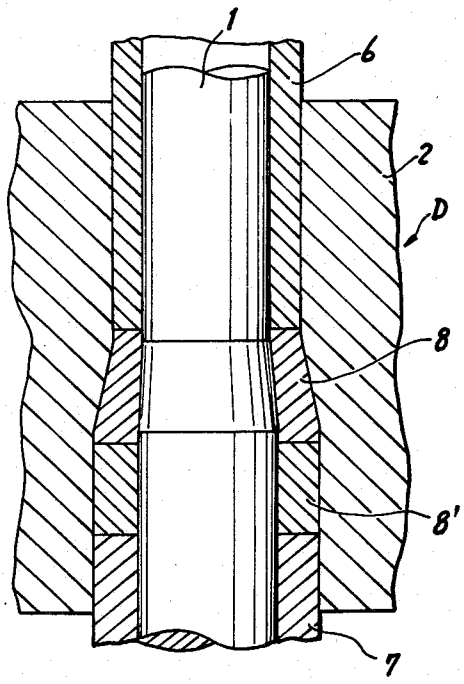
Figure 2C:
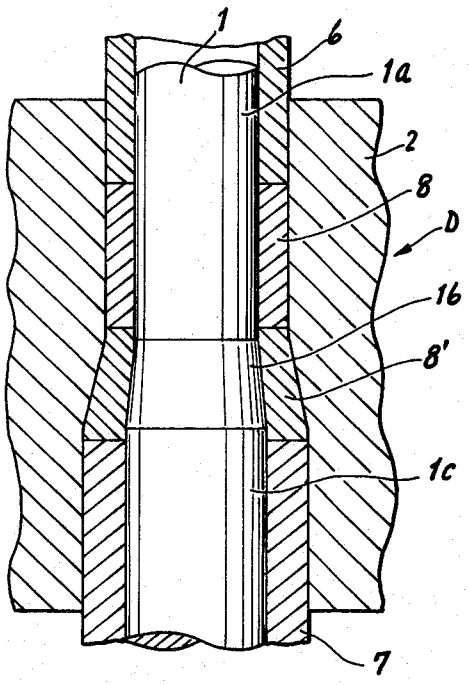

FIGS. 1(*a*) and 1(*b*), respectively, show the states prior to and after compression. In the figures, there is shown a part of die D which includes a mandrel or core 1 having a section 1*a* of a larger diameter, a frusto-conical section 1*b* and a section 1*c* of a smaller diameter and a die ring 2 in a coaxially spaced relationship thereby establishing a cavity C therebetween. The cavity C includes a container portion 3, a bearing portion 4 and an intermediate portion 5. The die D has a punch 6 inserted between the section 1*a* and the die ring 2 and a punch 7 provided between the section 1*c* and the ring die 2.

The container portion 3 is a portion where at least a part of a hollow cylindrical billet 8 prior to compressive working is accomodated and the bearing portion 4 is a portion where a billet 8' obtained after compressive working extrusion is received. It will be noted that a sectional area of the container portion almost corresponds to a sectional area of the billet 8 as seen from FIG. 1(*a*). The sectional area of the bearing portion 4 almost corresponds to a sectional area of the billet 8' in FIG. 1(*b*).

In FIGS. 1(*a*) and 1(*b*), the container and bearing portions are both circular in form and are formed around the extrusion core 1. Accordingly, the cavitied or sectional area of the container portion 3 is an area of a ring formed between outside and inside diameters of the container portion. The container 3 is in the form of a ring in section and can receive therein a hollow cylinder. Likewise, the cavitied area of the bearing portion is an area of a ring in section formed between outside and inside diameters of the bearing portion 4. For instance, when the outside and inside diameters of the container portion 3 are taken as 30 mm and 15 mm, respectively, and the outside and inside diameters of the bearing portion 4 are also taken as 33.2 mm and 16 mm, respectively, the cavitied areas of the container and bearing portions 3, 4 are, respectively, about 506 $mm^2$ and about 606 $mm^2$.

In operation, when the punch 6 is moved downwards, the billet 8 is plastically deformed gradually at a portion in the bearing and intermediate portions 4, 5. A portion of the billet in the container portion is restrained or protected by the section 1*a* of the core 1 and the ring die 2 and does not deform. As the compression proceeds, the billet 8 in the intermediate and bearing portions is plastically deformed in directions perpendicular to the direction of the movement of the punch 6 and radially extends towards the side wall of the ring die 2 and the outer surface of the core 1. Although the portion in the container portion 3 is moved downwards, it suffers little deformation so far as existing in the container portion. In the case shown in FIGS. 1(*a*) and 1(*b*), the punch 6 is not necessarily moved continuously but may be intermittently moved.

By the compressive working, a radially anisotropic magnet can readily be obtained. In order to more smoothly facilitate the compressive working using a die as shown in FIG. 1, the billet may be worked by a procedure as will be described with reference to FIGS. 2(*a*) through 2(*d*).

Another embodiment according to the invention is described with reference to FIGS. 2(*a*) through 2(*d*). As shown in FIG. 2(*a*), a hollow cylindrical billet 8' is first placed in the bearing portion 4. Then, the billet 8' is compressed upwardly by the use of the punch 7. As a result, the billet is plastically deformed as shown in FIG. 2(*b*). In this state, a hollow cylindrical billet 8 to be worked is placed in the container portion 3 as shown in FIG. 2(*c*) and the billets 8, 8' are moved downwards from the container portion 3 toward the bearing portion 5 while compressing the billets by means of the punches 6, 7, by which the billets 8,8' are deformed as shown in FIG. 2(*d*). In this state, the billet 8' is removed from the bearing portion 5 and then a fresh billet is inserted into the container portion 3 as shown in FIG. 2(*c*), followed by repeating the steps shown in FIGS. 2(*c*) and 2(*d*) to extrude hollow cylindrical billets one by one.

It will be noted that the steps shown in FIGS. 2(*a*) and 2(*b*), are not the step of extrusion according to the invention. The die shown in FIGS. 2(*a*) through 2(*d*) has a cavitied area of the container portion 3 smaller than a cavitied area of the bearing portion. The die has the intermediate portion 5 in which the cavitied area gradually increases from the container portion 3 toward the bearing portion 4. By the step shown in FIGS. 2(*a*) and 2(*b*), the cavity of the intermediate portion 5 is merely filled with a billet for starting the working of the invention. The extrusion step shown in FIGS. 2(*c*) and 2(*d*) embody the present invention. This embodiment involves a procedure in which the region of plastic deformation is continuously changed in relation to time. As shown, in this embodiment, the billet 8 is completely restrained by the core 1 and the ring die 2 invariably over the entire process of manufacture. Accordingly, a fairly long billet may be used depending on the design of the die, a feature not expected expected by prior art.

When the billets 8,8' are moved toward the bearing portion 4 while compressing the billets between the punches 6 and 7, the billet 8' suffers the compressive strain produced in the direction of the extrusion. Generally, the hollow billet is moved at a rate of 0.05 to 30 mm/sec. in the practice of the invention.

The billet prior to the extrusion is in the form of a cylinder. In order to suppress compressive deformation of the billet in the container portion which is being compressed, the billet should be protected from opposite sides by the core and the ring die between which the billet is set. The billet is plastically deformed when entering the conical part.

In order to facilitate easy insertion of the cylindrical billet 8 into the container, it is sufficient to shape the billet slightly smaller in thickness than a width of the container portion. The section of the hollow cylindrical billet 8 which is a plane vertical to the axial direction of the billet and the section of the container portion are both in the form of rings.

The anisotropic structure of a magnet obtained by the compressive working extrusion depends on the size of the billet prior to and after compression, i.e. the size parameter of the die. For instance, assuming that a billet prior to compression is in the form of a cylinder having an outer diameter of $D_{oo}$, an inner diameter of $D_{io}$ and a height of $h_o$ and a billet obtained after compression has an outer diameter of $D_o$, an inner diameter of $D_i$ and a height of h, It may be said that when $D_o$ is smaller than $D_{oo} \times \sqrt{h_o/h}$, the resulting magnet has a direction of easy magnetization along radial directions. When $D_o$ is equal to $D_{oo} \times \sqrt{h_o/h}$, the resulting magnet has a direction of easy magnetization within a plane including radial and tangential directions. Moreover, when $D_o$ is larger than $D_{oo} \times \sqrt{h_o/h}$, a direction of easy magnetization becomes tangential. In short, smaller ratios of $D_o$ to $D_{oo} \times \sqrt{h_o/h}$ result in magnets which are rendered more tangentially anisotropic. When the value of $D_{oo} \times \sqrt{h_o/h}$ is kept constant, magnetic characteristics in the radial direction become higher than in the tangential direction at a small value of $D_o$. As $D_o$ increases, the difference in magnetic characteristics between the tangential and radial directions becomes smaller. Over a certain value of $D_o$, higher magnetic characteristics in the tangential direction are obtained.

As will be understood from the above, long magnets can readily be obtained by the extrusion working technique in the practice of the invention. Moreover, magnets of different types of anisotropic structures can be obtained by suitably changing the sizes of the cavity portions of the die. In addition, when a magnet is compressed locally at either its outside or inside portions, the compressed portion can be changed in anisotropic structure to have a radial direction of easy magnetization.

As described, the plastic deformation is effected in a temperature range of 530° to 830° C. At temperatures exceeding 780° C., magnetic characteristics are found to decrease. Accordingly, a preferable temperature is in the range of 560°to 760° C.

The present invention is described more particularly by way of the following examples.

EXAMPLE 1

Figure 3:
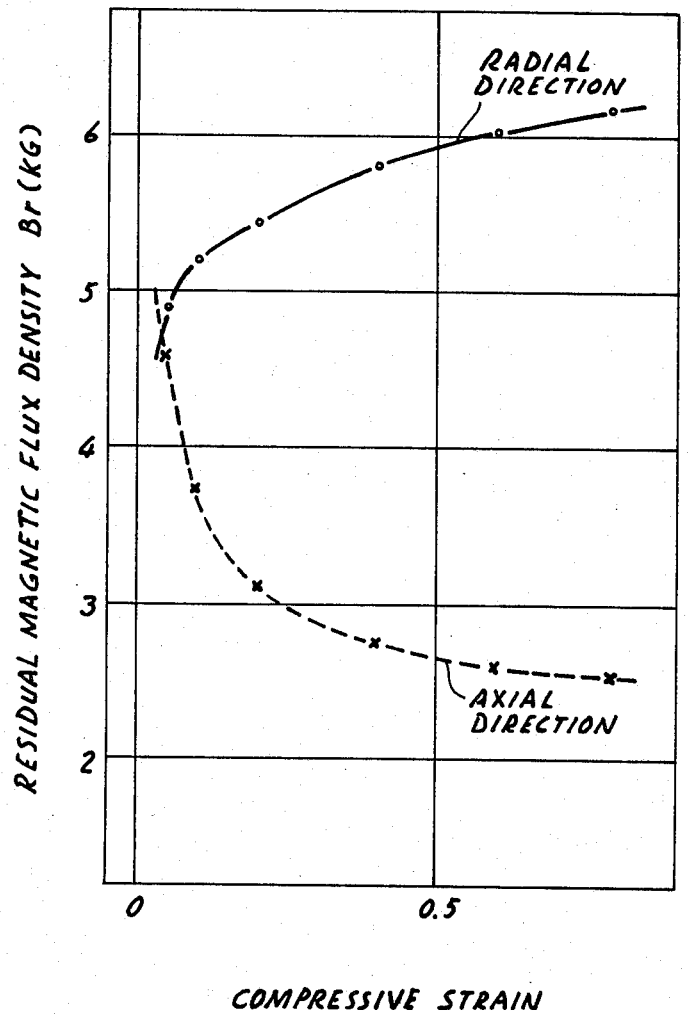
FIG. 3 is a graphical representation of residual magnetic flux density (Br) of a magnet obtained in Example 1 in relation to compressive strain ($\xi z$)

A charge composition comprising 69.5 wt % (hereinafter referred to simply as %) of Mn, 29.3% of Al, 0.5% of C and 0.7% of Ni was melted and cast in a mold thereby obtaining a solid cylindrical billet having a diameter of 70 mm and a length of 60 mm. The billet was maintained at 1100° C. for 2 hours, followed by cooling to room temperature. Thereafter, the billet was extruded through a lubricant at a temperature of 720° C. to a level of 45 mm in diameter, followed by further extrusion through a lubricant at 680° C. to a diameter of 31 mm. The resulting extruded rod was cut into pieces each having a length of 50 mm and machined to make several hollow cylindrical billets having an outer diameter of 30 mm, an inner diameter of 22 m and a length of 50 mm. These hollow billets were extruded at a temperature of 680° C. using a die as shown in FIG. 1 according to the procedure illustrated with reference to FIGS. 2(*a*) through 2(*d*). The die was designed to have a container portion with an outside diameter of 30 mm and an inside diameter of 22 mm and a bearing portion with an outside diameter of 32 mm and an inside diameter of 10 mm, and x=20 mm. Four billets on the way of the extrusion (i.e. kept in the intermediate portion 5 of FIG. 1(*b*)) were made and each billet was cut at a right angle with respect to the extrusion direction to a thickness of 1 mm. Pieces imparted with the same level of compressive strain were put one on another to obtain a sample. A cubic body having individual sides of about 4 mm was cut off from the samples and subjected to the measurement of magnetic characteristics. The measurement was effected such that the individual sides were parallel to axial, radial and tangential directions. A change of residual magnetic flux density, Br, in relation to compressive strain, $\xi_z$, is shown in FIG. 3. The results of FIG. 3 reveal that at $\xi_z=0.05$, the residual magnetic flux density, Br, is much larger in the radial direction than in the axial direction. A further increase of $\xi_z$ results in an increase of Br in the radial direction. As will be seen from the figure, the change of the direction of easy magnetization from the axial to radial directions sharply proceeds within a range of $\xi_z$ up to 0.05. It will be understood from FIG. 3 that high magnetic characteristics are obtained in spite of very small compressive strains. In other words, in order to obtain high magnetic characteristics in the radial direction by compressive working, a great compressive strain has to be imparted. In contrast, according to the method of the invention, there can be obtained magnets of high magnetic characteristics in a small degree of compressive strain.

Moreover, a billet having an outer diameter of 32 mm, an inner diameter of 10 mm and a length of 22.5 mm which had been extruded according to the present invention was cut from the inside part of the billet to give a cubic body having each side of 5 mm, followed by measurement of magnetic characteristics. In the measurement, the individual sides were arranged parallel to axial, radial and tangential directions.

The magnetic characteristics were found to be Br=6.2 kG, Hc=2.7 kOe and (BH)max=6.5 MG.Oe in the radial direction, Br=3.1 kG, Hc=2.3 kOe and (BH)max=2.0 MG.Oe in the tangential direction, and Br=2.5 kG, Hc=1.9 kOe and (BH)max=1.4 MG.Oe in the axial direction.

The extruded billet had an outer diameter of 32 mm, an inner diameter of 10 mm and a length of 22.5 mm and was a sufficiently long magnet.

EXAMPLE 2

The extruded rod having a diameter of 31 mm obtained in Example 1 was cut into pieces each having a length of 50 mm and machined to give several hollow cylindrical billets each having an outer diameter of 30 mm, an inner diameter of 15 mm and a length of 50 mm. Each billet was extruded at a temperature of 680° C. through a lubricant using a die of the same type as shown in FIG. 1 in a manner illustrated with reference to FIGS. 2(*a*) to 2(*d*). The die had a container portion with an outside diameter of 30 mm and an inside diameter of 15 mm and a bearing portion with an outside diameter of 42 mm and an inside diameter of 21 mm, and x=20 mm. A cubic body having each side of 5 mm was cut from the extruded billet in such a way that the individual sides were parallel to axial, radial and tangential directions, followed by measurement of magnetic characteristics.

The magnetic characteristics were almost equal in the radial and tangential directions, i.e. Br=4.5 kG, Hc=2.2 kOe and (BH)max=3.5 Mg.Oe, and were Br=2.6 kG, Hc=1.9 kOe and (BH)max=1.5 Mg.Oe in the axial direction.

The billet obtained after the extrusion has an outer diameter of 42 mm, an inner diameter of 21 mm and a length of 25 mm and was a sufficiently long magnet.

EXAMPLE 3

The extruded rod having a diameter of 31 mm obtained in Example 1 was cut to form a piece having a length of 50 mm and machined to give a hollow cylindrical billet having an outer diameter of 30 mm, an inner diameter of 10 mm and a length of 50 mm.

Thereafter, the cylindrical billet was extruded at a temperature of 680° C. through a lubricant using a die shown in FIGS. 1(*a*) and 1(*b*) by the procedure illustrated with reference to FIGS. 2(*a*) through 2(*d*). The die had a container portion with an outside diameter of 30 mm and an inside diameter of 10 mm and a bearing portion with an outside diameter of 63.2 mm and an inside diameter of 49 mm.

The billet after the extrusion had an outer diameter of 63.2 mm, an inner diameter of 49 mm and a length of 25 mm and was thus a long magnet.

A cubic body having each side of 5 mm was cut from the outside part of the extruded billet in such a way that the individual sides were arranged parallel to axial, radial and tangential directions, followed by measurement of magnetic characteristics.

The magnetic characteristics were found to be Br=5.9 kG, Hc=2.7 Oe and (BH)max=6.2 Mg.Oe in the tangential direction, Br=3.1 kG, Hc=2.3 kOe and (BH)max=2.0 Mg.Oe in the radial direction, and Br=2.6 kG, Hc=1.9 kOe and (BH)max=1.4 MG.Oe in the axial direction.

EXAMPLE 4

Figure 4:
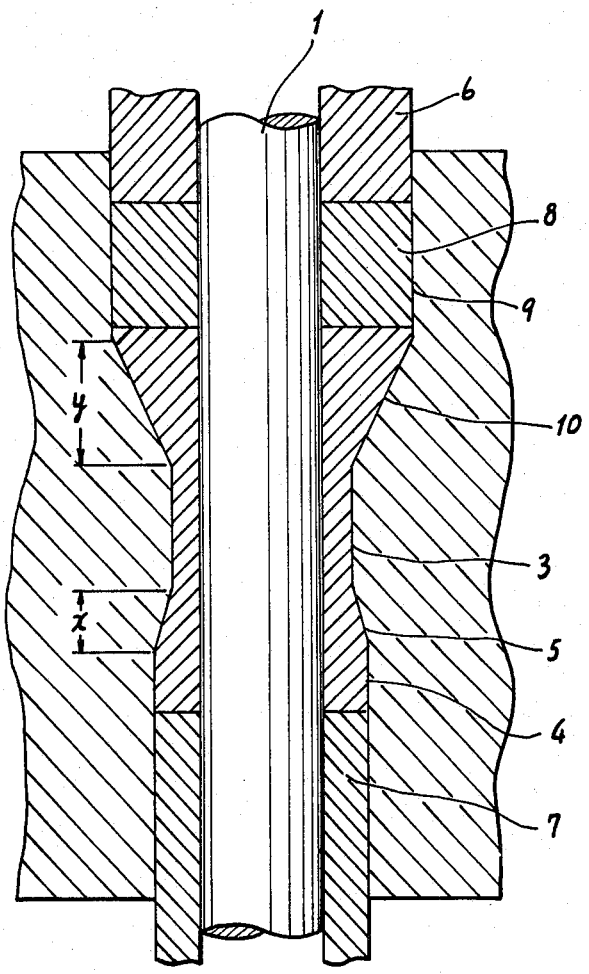
FIG. 4 is a schematic sectional view of part of a die used in Example 4.

A charge composition of 69.4% of Mn, 29.3% of Al, 0.5% of C, 0.7% of Ni and 0.1% of Ti was melted and cast to obtain a solid cylindrical billet having an outer diameter of 50 mm, an inner diameter of 20 mm and a length of 20 mm. This billet was kept at 1100° C. for 2 hours and cooled in air to 600° C., followed by keeping at 600° C. for 30 minutes and allowing to cool down to room temperature. Thereafter, the billet was extruded at 720° C. through a lubricant using a die shown in FIG. 4. In FIG. 4, indicated by 9, 10 and 6 are portions constituting a die used in known extrusion. In this connection, however, portions of a die used in extrusion according to the invention are designated by 3, 5 and 4, respectively, which correspond a container portion, an intermediate portion and a bearing portion. The portion 9 had an outside diameter of 50 mm, the portion 3 had an outside diameter of 30 mm and the portion 4 had an outside diameter of 36 mm with all the portions having an inside diameter of 20 mm. y=30 mm and x=10 mm. The billet prior to extrusion was accomodated as 8 in FIG. 4 and was compressed by means of the punches 6 and 7, under which the billet was moved from the portion 9 toward bearing portion 4 through the intermediate portion 5 and extruded. In order to attain the state shown in FIG. 4 in which the cavity of the die was almost completely filled with a billet, a hollow cylindrical billet having approximately the same outer and inner diameters as the portion 9 was extruded using the punch 6. Further, a hollow cylindrical billet having approximately the same outer and inner diameters as the bearing portion 4 was accomodated in the bearing portion 4 and extruded by the use of the punch 7. By the extrusion from the opposite sides the entire cavity could be filled with the billets. The cylindrical billet after the extrusion was cut into pieces having a length of 20 mm and machined to obtain a hollow cylindrical magnet having an outer diameter of 35 mm and an inner diameter of 21 mm.

The cylindrical magnet was subjected to the 8-pole magnetization around the inner lateral surface. For the magnetization, pulse magnetization was effect at 1500 V using an oil condenser of 2000 $\mu$F. The surface magnetic flux density on the inner lateral surface was measured by the Hall element. As a result, it was found that the density was in the range of 3.0 to 3.1 kG.

As will be appreciated from Example 4, the combination of the step where a billet was previously rendered anisotropic as in Example 4 and the method of the invention can reduce or simplify the manfacturing process.

What is claimed is:

1. A method for making an Mn—Al—C alloy magnet suitable for multipolar magnetization which comprises: (1) providing a starting hollow billet made of a polycrystalline Mn—Al—C alloy magnet which has been rendered anisotropic; (2) subjecting a first part of the entire hollow billet to compressive working at a temperature from 530° to 830° C. while keeping restrained a second part of the hollow billet along its length so that the second part is prevented from suffering compressive deformation until it is fed into a compressive working region in which the billet is plastically deformed, the compressive working region having a larger cross-sectional area than the second part cross-sectional area included between the inner and outer surfaces of the second part, the first part in the compressive working region being gradually compressed; and (3) further compressing the hollow billet until the entire hollow billet is plastically deformed in the compressive working region.

2. The method according to claim 1, wherein said hollow billet is compressed from opposite ends of the billet while moving toward the compressive working region.

3. The method according to claim 1, wherein said hollow billet is made of a polycrystalline Mn—Al—C alloy magnet having a direction of easy magnetization along an axial direction of said billet and is compressively strained to a level of at least 0.05 as expressed by an absolute value of logarithmic strain.

4. The method according to claim 1, wherein said hollow billet is moved at a rate of 0.05 to 30 mm/second.

5. The method according to claim 1, wherein said hollow billet is in the form of a cylinder.

6. The method according to claim 1, wherein said temperature is from 560° to 760° C.

7. A method for making an Mn—Al—C alloy magnet suitable for multipolar magnetization which comprises: (1) providing a hollow cylinder billet made of a polycrystalline Mn—Al—C alloy magnet which has been rendered anisotropic; (2) subjecting the hollow billet to compressive working at a temperature from 530° to 830° C. such that the billet is gradually deformed in a compressive working region so as to increase the cross-sectional area of the billet included between the inner and outer surfaces of the billet while keeping restrained the billet from its inner and outer surfaces during the course of the compressive working; and (3) continuing the compressive working until the entire billet is plastically deformed.

8. The method according to claim 7, wherein said hollow billet is compressed from opposite ends of the billet while moving toward the compressive working region.

9. The method according to claim 7, wherein said hollow billet is made of a polycrystalline Mn—Al—C alloy magnet having a direction of easy magnetization along an axial direction of said billet and is compressively strained to a level of at least 0.05 as expressed by an absolute value of logarithmic strain.

10. The method according to claim 7, wherein said hollow billet is moved at a rate of 0.05 to 30 mm/second.

11. The method according to claim 7, wherein said hollow billet is in the form of a cylinder.

12. The method according to claim 7, wherein said temperature is from 560° to 760° C.

13. A manganese-aluminum-carbon alloy magnet obtained by the method of claim 1 or 7, said magnet having a direction of easy magnetization parallel to the radial or tangential direction.

14. The method according to claim 1 or 7, wherein said hollow billet is made of a polycrystalline manganese-aluminum-carbon alloy magnet which has a direction of easy magnetization parallel to a first plane perpendicular with respect to the axial direction of said hollow billet, is magnetically isotropic within said plane, and is anisotropic in a direction of a perpendicular with respect to said plane, and within a second plane including a straight line parallel to the first plane.

* * * * *